United States Patent [19]

Reinert

[11] 4,241,641

[45] Dec. 30, 1980

[54] PILOT ASSEMBLY FOR HYDRAULIC PUMPS

[76] Inventor: Gerald H. Reinert, 6 Brightwood Rd., Cold Spring, Ky. 41076

[21] Appl. No.: 933,443

[22] Filed: Aug. 14, 1978

[51] Int. Cl.[3] ..... F01L 21/02; F01L 25/06

[52] U.S. Cl. ..... 91/189 A; 91/193; 91/291; 91/293; 91/400; 91/520

[58] Field of Search ..... 91/189 A, 291, 293, 91/294, 520, 191, 193

[56] References Cited

U.S. PATENT DOCUMENTS

| | | | |
|---|---|---|---|
| 2,069,122 | 1/1937 | Weaver | 91/291 |
| 2,112,466 | 3/1938 | Maloon | 91/189 A |
| 3,774,696 | 11/1973 | Horsch | 91/520 |

FOREIGN PATENT DOCUMENTS

| | | | |
|---|---|---|---|
| 913324 | 5/1946 | France | 91/294 |

*Primary Examiner*—Paul E. Maslousky

*Attorney, Agent, or Firm*—Tilton, Fallon, Lungmus & Chestnut

[57] ABSTRACT

A pilot assembly for switching the fluid supply valve of a hydraulic pump is actuated by the pressurized hydraulic fluid which operates the hydraulic pump. The hydraulic pump includes a main cylinder, a main piston within the main cylinder, and a main valve for supplying pressurized hydraulic fluid to the rear end of the main cylinder for driving the piston forwardly. The pilot assembly includes a pilot cylinder and a pilot spool within the cylinder. A first hydraulic conduit connects one end of the pilot cylinder to the front end of the main cylinder, and a second hydraulic conduit connects the other end of the pilot cylinder to the main cylinder at a position spaced rearwardly from the front end of the main cylinder. When the main piston passes forwardly of the second hydraulic conduit, the pressurized hydraulic fluid in the main cylinder moves the pilot spool, and pressurized hydraulic fluid is allowed to flow to the main valve to switch the main valve.

1 Claim, 4 Drawing Figures

PILOT ASSEMBLY FOR HYDRAULIC PUMPS

BACKGROUND

This invention relates to a pilot assembly for a hydraulic pump. A typical hydraulic pump includes a hydraulic cylinder, a piston which is reciprocable within the hydraulic cylinder, a source of pressurized hydraulic fluid for driving the piston, and a valve for controlling the flow of pressurized hydraulic fluid to the cylinder. The invention finds particular utility with hydraulic pumps used in concrete pumping machines, and the invention will be explained in conjunction with concrete pumps. However, it will be understood that the invention is not limited to concrete pumps but can be used with any hydraulic pump in which pilot pressure is used to switch the main hydraulic valve of the pump.

A concrete pump includes one or more pumping cylinders for pumping concrete and a hydraulic cylinder for each pumping cylinder for driving the piston in the pumping cylinder. Each hydraulic cylinder includes a piston which is extended and retracted during the pumping cycle by hydraulic fluid, and the piston in the hydraulic cylinder drives the piston in the pumping cylinder by means of a rigid connecting rod or the like.

Most concrete pumps include a pair of pumping cylinders and a pair of hydraulic cylinders. The hydraulic cylinders are conventionally synchronized for tandem operation so that one piston is being retracted while the other piston is being extended. This synchronization can be achieved by a slave system which includes a crossover pipe connecting the forward ends of the hydraulic cylinders. As one of the pistons is being extended toward the forward end of the cylinder by pressurized hydraulic fluid, the hydraulic fluid between the rod end of the piston and the forward end of the cylinder, i.e., slave fluid, is forced through the crossover pipe into the other hydraulic cylinder to force the second piston rearwardly. Conversely, when pressurized hydraulic fluid is pumped into the other cylinder to extend the second piston, the second piston forces the slave fluid through the crossover to retract the first piston.

A concrete pump with two hydraulic cylinders generally includes a main 4-way valve which is movable between two positions for alternately supplying pressurized hydraulic fluid to one hydraulic cylinder and then the other. When the main valve is supplying pressurized hydraulic fluid to one cylinder to extend the piston in that cylinder, the valve permits the hydraulic fluid in the other cylinder to pass through the valve to the fluid reservoir as the piston in that cylinder is retracted by the slave fluid.

The main valve is switched back and forth between its two operating positions by a pilot system which can be either electrical or hydraulic. The pilot system switches the main valve when the piston in either of the cylinders reaches its fully extended position.

A concrete pump with only a single hydraulic cylinder also includes a main valve which is movable between two positions. In one position pressurized hydraulic fluid flows through the valve into one end of the cylinder to extend the piston, and hydraulic fluid which is forced out of the cylinder by the extending piston flows through the valve to the fluid reservoir. In the other position the valve directs pressurized hydraulic fluid to the other end of the cylinder to retract the piston, and hydraulic fluid which is forced out of the first end of the cylinder by the retracting piston returns to the fluid reservoir through the valve. The valve is also operated by a pilot system.

Pilot systems which have heretofore been used for switching the main valve usually include some movable element which is engageable by the hydraulic piston or connecting rod as the hydraulic piston reaches the limit of its movement in one direction. Such a movable element can take the form of a travel rod, pin, roller, spring, spool, etc., and the movable element is usually placed in the head of the hydraulic cylinder or at least closely adjacent the hydraulic cylinder. A major problem with such a pilot system is that the pilot system is not readily accessible for inspection, repair, or replacement, and a pilot system which must be moved by the piston or piston rod can cause damage in the event of jams or the like.

SUMMARY OF THE INVENTION

The invention eliminates the need for any moving part which must be engaged by the piston or piston rod and enables the pilot system to be mounted remotely from the hydraulic cylinder. The pilot system includes a pilot cylinder and a pilot piston, and the pilot piston is operably connected to the main cylinder merely by two openings in the main cylinder. One of the openings is placed in the end of the main cylinder toward which the main piston is extended by the pressurized hydraulic fluid, and the second opening is located behind the position which the main piston reaches when it is desired to switch the main valve. As the main piston passes the second opening, pressurized hydraulic fluid flows through the second opening into the pilot cylinder to switch the pilot piston. This permits pressurized hydraulic fluid to flow to the main valve for switching the main valve. When the main piston is retracted, the fluid pressure on both ends of the pilot piston is equal. However, the pilot piston is returned to its original position because the surface area of the piston face which communicates with the second opening is less than the surface area of the piston face which communicates with the first opening. Return of the pilot piston may be assisted by a spring. When the pilot piston returns to its original position, hydraulic fluid can flow from the main valve through the pilot cylinder to the reservoir.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
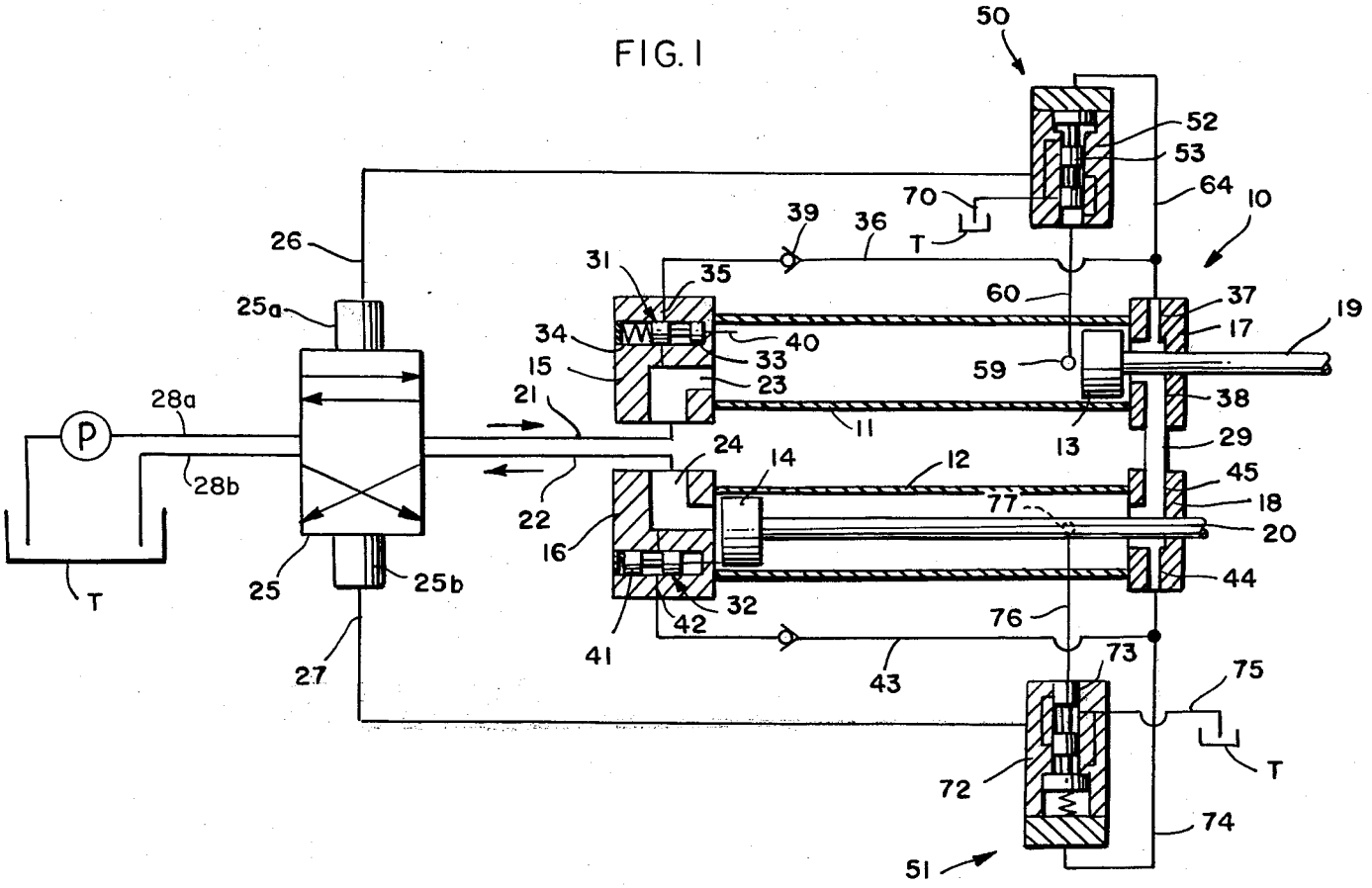
FIG. 1 is a diagrammatic view of a pair of hydraulic pumping cylinders and a pilot system for each hydraulic pumping cylinder.

Referring to FIG. 1, the numeral 10 designates generally a driving assembly for operating a pair of pumping cylinders (not shown) in tandem. The driving assembly has particular utility in driving a pair of concrete pumping pistons such as described in my U.S. Pat. No. 3,650,641.

The driving assembly 10 includes a pair of hydraulic cylinders 11 and 12 which slidably receive pistons 13 and 14, respectively. The rearward ends of the cylinders 11 and 12 are closed by end caps 15 and 16, and the forward ends are closed by end caps 17 and 18. A connecting rod 19 is connected to the piston 13 and extends slidably through the forward end cap 17 for connection to one of the pumping pistons. Similarly, connecting rod 20 extends slidably through the end cap 18 between the piston 14 and the other pumping piston.

Each of the pistons 13 and 14 can be driven to the forward or extended position occupied by the piston 13 by pressurized hydraulic fluid introduced into the cylinders 11 and 12 by the fluid supply conduits 21 and 22, respectively. The conduit 21 is connected to an internal fluid passage 23 in the end cap 15 which opens into the cylinder 11, and the conduit 22 is connected to an internal fluid passage 24 in the end cap 16 which opens into the cylinder 12.

The pressurized hydraulic fluid can be supplied by a conventional hydraulic pump P from a fluid reservoir or tank T, and pressurized fluid is alternately directed to the cylinders 11 and 12 by a conventional 4-way valve 25. The operation of the 4-way valve is well known in the art, and the valve need not be explained in detail. It is sufficient to say that the valve includes a movable internal valve member which is movable between first and second positions by fluid pressure which is exerted on the valve member through conduits 26 and 27 which are connected to fluid inlets **25*a* and 25*b*. In the first position of the valve pressurized hydraulic fluid from the pump flows through conduit 28*a* and through the valve into the conduit 21 and cylinder 11 to extend or drive the piston 13 forwardly, and fluid in the cylinder 12 which is forced out of the cylinder by the retracting pistion 14 flows through the valve and through conduit 28*b* to the tank. In the second position of the valve pressurized hydraulic fluid from the pump flows through conduit 28*a* and through the valve into the conduit 22 and cylinder 12 to extend or drive the piston 14, and fluid which is forced from the cylinder 11 by the retracting position 13 flows through the valve and through conduit 28*b*** to the tank.

In order to synchronize the movements of the two pistons so that one piston is retracted while the other is extended, a crossover pipe 29 is provided between the forward end caps 17 and 18, and the cylinders are filled with hydraulic fluid forwardly of the rod ends of the pistons, i.e., the ends of the pistons to which the connecting rods 19 and 20 are secured. Accordingly, as the piston 13 is extended, the slave hydraulic fluid forwardly of the rod end of the piston is forced through the crossover pipe 29 into the forward end of the cylinder 12. Since the fluid supply condiut 22 is communicated with the fluid tank by the main 4-way valve 25 when pressurized fluid is pumped through the fluid supply conduit 21 in the cylinder 11, the slave fluid which is forced through the crossover pipe 29 forces the piston 14 rearwardly. The hydraulic fluid behind the head end of the piston 14, i.e., the end of the piston opposite the connecting rod 20, is freely forced through the conduit 22 and through the main 4-way valve to the tank as the piston 14 retracts.

In order to make sure that the pistons 13 and 14 reach their fully extended positions, valve assemblies 31 and 32 are mounted in the end caps 15 and 16 of the cylinders 11 and 12. The structure and operation of these valve assemblies is explained in detail in my U.S. Pat. No. 3,778,193, to which reference may be had for details. The valve assembly 31 includes a spring-biased spool 33 which is slidably positioned within a bore 34 in the end cap 15. The spool opens and closes a fluid passage 35 in the end cap which communicates with the fluid passage 23 and which is connected by a fluid conduit 36 to a fluid passage 37 in the forward end cap 17. The fluid passage 37 communicates with a fluid passage 38 which connects the crossover pipe 29 to the cylinder 11. A check valve 39 in the conduit 36 permits fluid to flow only from the forward end of the cylinder to the rear end. A pin 40 on the spool extends into the cylinder 11 and is engageable by the piston 13 when the piston retracts.

The valve assembly 32 similarly includes a spool 41 which opens and closes a fluid passage 42 in the end cap 16. A fluid conduit 43 connects the fluid passage 42 and a fluid passage 44 in the front end cap 18, the fluid passage 44 communicating with a fluid passage 45 which connects the crossover pipe 29 and the cylinder 12. A check valve 46 is positioned in the conduit 43, and a pin 47 on the spool is shown being engaged by the piston 14 to move the spool rearwardly to open the passage 42.

When the spool 41 is in its rearward position, slave fluid from the rod end of the cylinder 11 can flow through the conduit 43, through the rear end cap 16, and through the main 4-way valve 25 to the reservoir to ensure that the piston 13 reaches its fully extended position even after piston 14 reaches its fully retracted position. Similarly, when the piston 13 reaches its fully retracted position, the spool 33 will be moved by the piston to open the fluid passage 35 so that any excess slave fluid in the cylinder 12 will be vented to the tank through the conduits 36 and 21.

Figure 2:
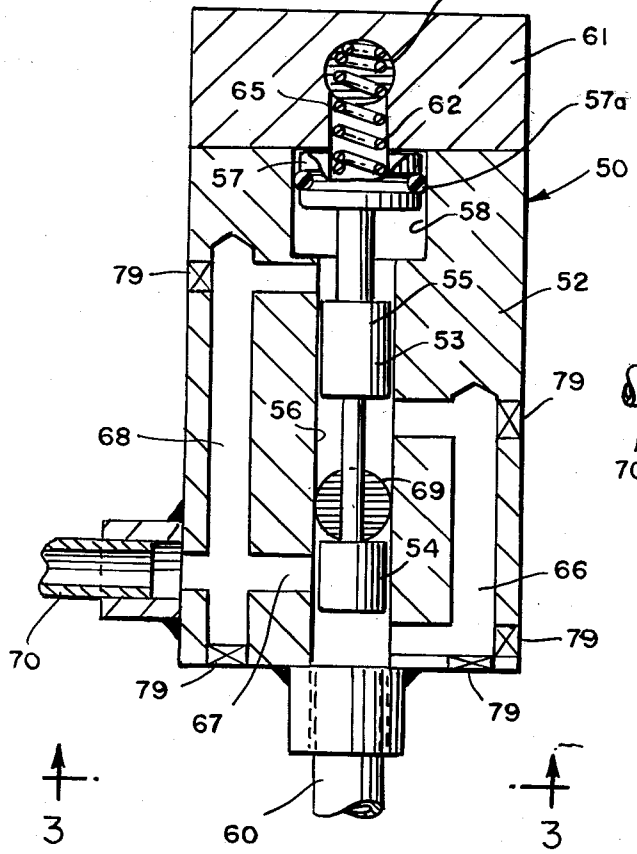
FIG. 2 is an enlarged sectional view of one of the pilot cylinders of FIG. 1.

Pilot assemblies designated generally by the numerals 50 and 51 are operably associated with the cylinders 11 and 12 for switching the main valve 25 between its first and second positions. The pilot assembly 50 includes a cylinder block 52 and a pilot spool 53 within the cylinder block. Referring to FIG. 2, the pilot spool includes a pair of pistons 54 and 55 which slide within a bore 56 in the cylinder block and a radially enlarged piston 57 which slides within an enlarged bore 58. The large piston 57 carries an O-ring **57*a* which sealingly engages the wall of the bore 58. The lower end of the bore 56 is connected to a port 59 (FIG. 1) in the cylinder 11 by a conduit 60. The head end of the piston 13 has passed the port 59 in FIG. 1, and pressurized hydraulic fluid from the cylinder 11 flows through the conduit 50 and forces the spool 53 to its upper position shown in FIGS. 1 and 2**.

Figure 3:
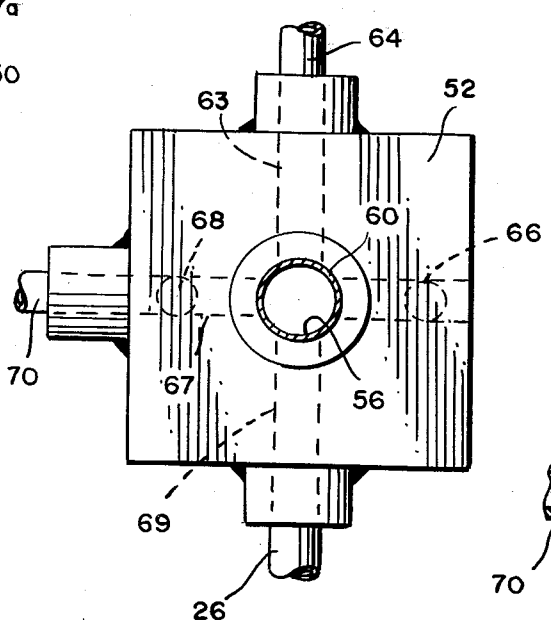
FIG. 3 is a bottom plan view of the pilot cylinder taken along the line 3—3 of FIG. 2.

An end cap 61 is mounted on the upper end of the cylinder block 52 and is provided with a bore 62 which extends coaxially with the bore 58 and a bore 63 which extends perpendicularly to the bore 62 (see also FIG. 3). The bore 63 is connected to the conduit 36 (FIG. 1) at the front of the cylinder 11 by a conduit 64. A spring 65 in the bore 62 urges the spool 53 downwardly, but the pressurized hydraulic fluid which acts on the lower end of the spool overcomes the bias of the spring and maintains the spool in its raised position.

The cylinder block 52 is provided with a generally C-shaped fluid passage 66 which connects the portions of the bore 56 below the pistons 54 and 55 when the spool is in its raised position shown in FIG. 2. The spool is shown in its alternate or lowered position in FIG. 4, and the pistons 54 and 55 block both ends of the passage 66.

A fluid passage 67 extends transversely outwardly from the bore 56 and is blocked by the piston 54 when the spool is in the raised position of FIG. 2. The passage 67 communicates with the upper end of the bore 56 through a passage 68 in both positions of the spool.

A bore 69 (see FIGS. 2 and 3) extends transversely outwardly from the bore 56 between the pistons 54 and 55, and the conduit 26 (FIG. 1) connects the bore 69 with the main 4-way valve 25. The passage 67 in the cylinder block is connected to the fluid tank by a conduit 70 (FIG. 1).

The pilot assembly 51 (FIG. ) includes an identical cylinder block 72 and spool 73. The large bore of the cylinder block (corresponding to bore 58 of cylinder block 52) is connected to the conduit 43 by a conduit 74. The portion of the bore between two small pistons of the spool is connected to the main 4-way valve by the conduit 27, and the fluid passage corresponding to passage 67 of cylinder block 52 is connected to the fluid tank by conduit 75. A conduit 76 connects the main bore of the cylinder block to a port 77 in the forward end of the main cylinder 12.

The hydraulic pump is illustrated in FIG. 1 at the moment that the piston 13 has reached its forwardmost position to switch the pilot assembly 50. The piston 13 was driven forwardly by hydraulic fluid pumped into the cylinder 11 through the main valve 25, and the piston 14 was retracted by the slave fluid which flowed through the crossover pipe 29. The fluid which was expelled from the cylinder 12 by the retraction of the piston 14 flowed through the main valve 25 to the fluid tank.

Throughout most of the forward stroke of the piston 13 the pressure on both sides of the pilot spool 53 was equal to the pressure of the slave fluid in the cylinder 11 and the conduits 60 and 64. Since the surface area of the large piston 57 of the pilot spool 53 is greater than the surface area of the small piston 54, the force exerted on the large piston will be greater than the force exerted on the small piston even though the pressure on both sides of the spool is equal. The greater force on the large piston, in addition to the force exerted by the spring 65, will cause the spool to be maintained in its lower position shown in FIG. 4.

When the head end of the piston 13 passes the port 59 in the main cylinder 11, the pressure in the conduit 60 and the pressure on the piston 54 of the pilot spool 53 is raised to the system pressure of the hydraulic fluid which is pumped by the pump P. The pilot spool will thereupon be moved from its FIG. 4 position to its FIG. 2 position. In this position the piston 54 opens the lower end of the fluid passage 66 of the cylinder block 52, and high pressure hydraulic fluid flows through the passage 66, through the transverse bore 69, and through the conduit 26 (FIG. 1) to switch the main 4-way valve 25 so that the hydraulic fluid pumped by the pump P will be switched from the main cylinder 11 to the main cylinder 12. The position of the opening 59 with respect to the position which the piston 13 occupies in its forwardmost position is selected so that the main valve 25 will not be switched until the piston 13 reaches its forwardmost position. However, because of the lead time which is required to switch the pilot spool 53 and the main valve 25, it might be advantageous to locate the opening 59 somewhat rearwardly of the position which the head end of the piston 13 occupies in its forwardmost position so that this lead time can be accommodated and the switching of the valve 25 will not be delayed after the piston 13 comes to rest.

Figure 4:
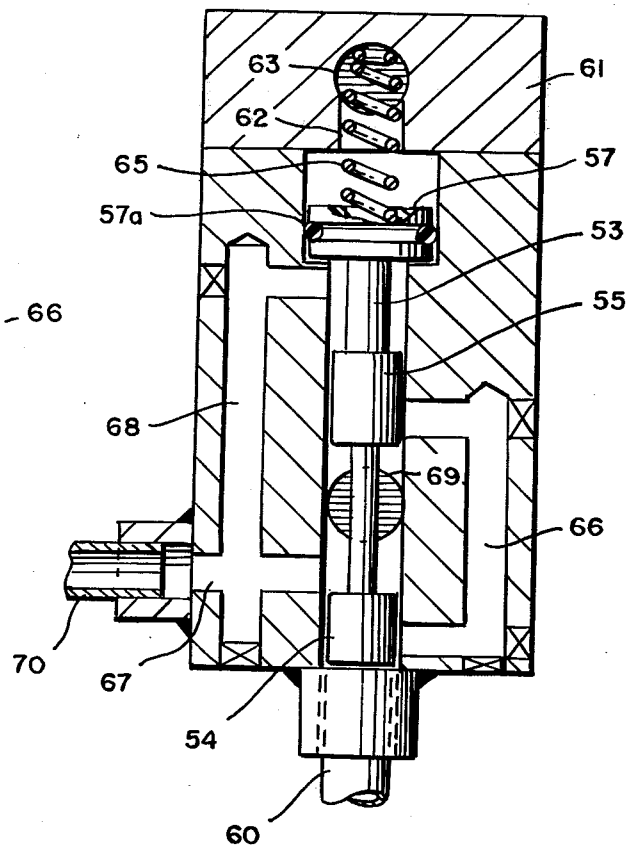
FIG. 4 is a view similar to FIG. 2 showing the pilot piston in its alternate position.

When the main piston 13 reaches its forward position and the main 4-way valve 25 is switched, the spool 73 of the pilot assembly 51 is in a position corresponding to the position of the spool 53 in FIG. 4. In this position the conduit 27 which is connected to the 4-way valve is connected through the cylinder block 72 to the conduit 75 which leads to the tank. Accordingly, when pilot fluid flows through conduit 26 to switch the main 4-way valve, the switching of the 4-way valve expels fluid from the other side of the valve through the conduit 27 to the tank.

After the main valve 25 is switched, the operation of the main pistons is reversed. Hydraulic fluid is pumped by the pump P through the main valve into the main cylinder 12 and extends the piston 14 from its retracted position illustrated in FIG. 1. The slave fluid forced through the crossover pipe 29 by the extending piston 14 causes the piston 13 to retract. When the rod end of the main piston 13 is pushed rearwardly of the opening 59 in the cylinder 11 by the slave fluid, both conduits 60 and 64 will be at the same pressure, i.e., the pressure of the slave fluid. However, as previously discussed, the surface area differential between the large piston 57 and smaller piston 54, plus the force exerted by the spring 65, will cause the pilot spool 53 to move from its FIG. 2 position to its FIG. 4 position.

When the head end of the piston 14 passes the opening 77 in the cylinder 12, high pressure hydraulic fluid will flow through the conduit 76 to switch the spool 73 of the pilot assembly 51 from the position corresponding to FIG. 4 to the position corresponding to FIG. 2. This movement of the spool will allow high pressure fluid to flow through the conduit 27 to switch the main 4-way valve 25. The switching of the valve expels fluid through the conduit 26, through the cylinder block 52 of the pilot assembly 50 (FIG. 4), and through the conduit 70 to the tank. The cycle is then repeated, and the high pressure fluid is switched by the main 4-way valve to the cylinder 11.

It will be appreciated from the foregoing description that the pilot assemblies can be located remotely from the main cylinders at any location on the pumping apparatus which will permit ready access to the pilot assemblies for inspection, repair, or replacement. The pilot assemblies can be operably connected to the main cylinders merely by extending flexible hydraulic hoses or the like to the main cylinder. Further, the actuation of the pilot assemblies does not require any moving parts associated with the main pistons. All that is needed to operably connect each pilot assembly to a main cylinder is two openings, one at the forward end of the cylinder and one at a position spaced slightly rearwardly of the head end of the piston when the piston is fully extended. The opening at the forward end of the cylinder is providing slave pressure on the large piston of the spool, and this opening can be made in the crossover pipe 29 or any other convenient location.

The cylinder blocks 52 and 72 of the pilot assemblies are advantageously made from solid blocks of metal in which the various bores and fluid passages are drilled. The drill openings can be closed by plugs 79 (FIG. 2) to form the desired fluid paths. The end cap 61 can be removably secured to the cylinder block so that the spool 53 and spring 64 can be inspected and replaced without disconnecting any of the other plumbing.

The fluid passage through the cylinder block for supplying pressurized fluid to the main 4-way valve is open and closed by simply shearing action of the spool, and there is little possibility of wear or failure. Similarly, the ports 59 and 77 in the main cylinders are opened to high pressure fluid by a simple shearing action.

Although I have described my invention in conjunction with a dual cylinder pump, it will be understood that the pilot assembly can also be used with a single pumping cylinder or more than two pumping cylinders.

While in the foregoing specification, a detailed description of a specific embodiment of the invention was set forth for the purpose of illustration, it is to be understood that many of the details herein given may be varied considerably by those skilled in the art without departing from the spirit and scope of the invention.

I claim:

1. In a hydraulic pumping apparatus having first and second main hydraulic cylinders, each of the main cylinders having an elongated bore and front and rear ends, a main piston reciprocable within the bore of each cylinder, hydraulic fluid supply means for supplying hydraulic fluid under pressure to the cylinders, main valve means connecting the hydraulic fluid supply means to the cylinders for alternately supplying pressurized hydraulic fluid to the first and second cylinders, the main valve means having a pair of hydraulic fluid inlets and being alternately movable between first and second positions by hydraulic fluid alternately forced into said inlets, the main valve means being movable between a first position in which pressurized hydraulic fluid passes through the main valve means to the first cylinder and a second position in which pressurized hydraulic fluid passes through the main valve means to the second cylinder, hydraulic fluid connecting means connected to the front end of each of the cylinders for permitting hydraulic fluid to flow from one cylinder as the piston therein is extended to the other cylinder for retracting the piston in the other cylinder; an improved pilot assembly for each of the first and second main cylinders for moving the main valve means between its first and second positions, each of the pilot assemblies comprising a pilot cylinder, a pilot spool in the pilot cylinder reciprocable between first and second positions, a first fluid conduit connecting one end of the pilot cylinder to the front end of the associated main cylinder, a second fluid conduit connecting the other end of the pilot cylinder to the associated main cylinder at a position spaced rearwardly from the front end of the main cylinder, the spacing between the second conduit and the front end of the main cylinder being sufficient to permit the main piston in the main cylinder to pass the second conduit when the main piston is in its forwardmost position whereby pressurized hydraulic fluid flowing into the main cylinder from the hydraulic fluid supply means can flow through the second conduit into the pilot cylinder to move the pilot spool from its first position to its second position when the piston moves forwardly past the second conduit, a third fluid conduit connecting the pilot cylinder to one of the hydraulic fluid inlets of the main valve means, and connecting means in the pilot cylinder for providing a fluid path between the second fluid conduit and the third fluid conduit, the spool closing said fluid path when the spool is in its first position and opening said fluid path when the spool is in its second position whereby pressurized hydraulic fluid can flow from the second conduit to the third conduit and through the hydraulic fluid inlet of the main valve for moving the main valve from one of its positions to its other position when the spool is moved to its second position.

* * * * *